US006398078B1

(12) United States Patent
Moran et al.

(10) Patent No.: US 6,398,078 B1
(45) Date of Patent: Jun. 4, 2002

(54) PACKAGE AND CADDY FOR BEVERAGE BOTTLES

(76) Inventors: Michael J. Moran, 206 Mt. Pleasant Rd., New Bern, NC (US) 28560; Ryan L. Bott, 689 N. 100 West Apt. D; Randy L. Bott, 1699 N. 210 East, both of Orem, UT (US) 84057

( * ) Notice: Subject to any disclaimer, the term of this patent is extended or adjusted under 35 U.S.C. 154(b) by 0 days.

(21) Appl. No.: 09/930,427

(22) Filed: Aug. 15, 2001

(51) Int. Cl.[7] ..... B67D 5/64

(52) U.S. Cl. ..... 222/173; 222/185

(58) Field of Search ..... 222/173, 180, 222/181.1, 185, 325, 481.5, 484, 501, 509; 251/245; D7/602, 619; 137/588, 594

(56) References Cited

U.S. PATENT DOCUMENTS

| | | | | | |
|---|---|---|---|---|---|
| 5,238,160 | A | * | 8/1993 | Faulds | 222/173 |
| D351,845 | S | * | 10/1994 | Johnson et al. | D7/602 |
| 5,624,043 | A | * | 4/1997 | Baptista | D7/619 |
| 5,743,438 | A | * | 4/1998 | Sokolnicki | 222/181.1 |

* cited by examiner

*Primary Examiner*—William C. Doerrler
*Assistant Examiner*—Thach H. Bui

(57) ABSTRACT

A pint-of-sale package for two to six large beverage bottles also serves as a dispensing caddy that provides ease and security of beverage dispensing. A venting, beverage-dispensing valve replaces the normal screw-on bottle cap to provide convenient beverage dispensing and reliable carbonation maintenance. The bottle package provides means for co-packaging associated products, such as snack foods, with the bottled beverage.

11 Claims, 8 Drawing Sheets

PACKAGE AND CADDY FOR BEVERAGE BOTTLES

CROSS-REFERENCE TO RELATED APPLICATIONS

Not applicable.

1. Background—Field of Invention

This invention relates to beverage bottle packaging and beverage dispensing, specifically, to an improved point-of-sale package for multiple, large bottles of beverage.

2. Background—Description of Prior Art

The development of PET bottles, that are suitable for carbonated beverages, has had an enormous impact on the packaging and marketing of soft drinks. Much of current production is bottled in two liter, or larger, plastic bottles. The bottles themselves are strong and light weight, and are very popular with the buying public. However, there are some well-recognized problems, associated with large bottles of beverage.

Due to the volume of beverage in one bottle, it sometimes takes several days for a bottle to be emptied. Unless a consumer is careful to keep the bottle tightly capped between pourings, much of the carbonation can be lost and the beverage will "go flat".

The walls of PET bottles are relatively impermeable to carbon dioxide, and when tightly capped will maintain carbonation for a long time. However, the bottle must be able to maintain sufficient pressure to keep the carbon dioxide dissolved in the beverage; when the bottle is not tightly sealed, the pressure is reduced to near atmospheric, and carbon dioxide will come out of solution, and be subsequently lost to the atmosphere.

Loss of carbonation is often evident when young children use such bottles. Children are relatively weak and sometimes careless; they often fail to sufficiently tighten the bottle cap when replacing it. Another reason for loose caps is that there is no visual distinction between a tightly capped bottle, and one that is loosely capped and losing carbonation.

Additionally, full bottles are heavy and awkward; children and enfeebled adults often have difficulty using the bottles. The weight and shape of the bottles make them unwieldy for pouring. Single handed pouring is impractical; using two hands to pour usually means that the cup or glass is unsupported, often resulting in spilled beverage. To make matters worse, chilled bottles, placed in warmer air for serving, become wet and slippery as condensate forms on the bottles.

Not only are the full bottles awkward to pour from, they are inconvenient to carry. The previously popular thin-walled, paperboard, six-pack cartons were suitable for carrying smaller bottles, but are not practical for two-liter and larger bottles, because of increased weight and size. Also, because of their high height-to-diameter ratio, it is not practical to stand the bottles upright, while they are being transported in an automobile; it takes very little lateral force to tip over such a bottle, especially when full. For the same reason, it is often risky to set such bottles upright on uneven or unlevel surfaces such as are often associated with outdoor picnic tables.

Prior art has addressed each of these problems, but has treated them separately. For example, U.S. Pat. No. 6,059,099 to Galbierz (2000) addresses packaging bottles for selling and carrying, but does not address the other problems listed above. The invention taught therein is a paperboard, multi-bottle carrier for carrying up to six bottles. As revealed in the specification, six bottles of two-liter capacity will weigh in the neighborhood of 24 pounds. The means, of holding and carrying the pack, is two holes in the top surface, which are spaced and sized for inserting a thumb and a finger. It is obvious that a significant portion of the population that buys soft drinks cannot carry 24 pounds with a thumb and a finger. Although the invention is effective for bundling multiple bottles together and for making such bundles stable in the upright position, it is not practical for carrying heavy loads. It will also be appreciated that the invention does not address the other, above mentioned, problems dealing with carbonation and dispensing.

U.S. Pat. No. 3,814,293 to Daves (1974) addresses the problems, of maintaining carbonation and of beverage dispensing, which are associated with large bottles, but does not address the packaging and carrying problems. The patent teaches a valve, that replaces the normal screw-on bottle cap prior to dispensing, and that provides for ease of valve opening for beverage dispensing, and for pressure maintenance while not dispensing. The patent further teaches the use of a bottle caddy to hold the bottle in an inclined position suitable for pouring. Once a large bottle is placed in the caddy, with the specified valve properly attached, beverage dispensing is accomplished without further lifting and tilting of the bottle. Further, the caddy provides a stable platform for the bottle, reducing the tendency for tipping over.

The valve described is simple in construction, but impractical for use with thin walled PET bottles. Because the valve does not permit vented flow, a negative pressure obtains in the bottle during beverage dispensing, causing a disagreeable and slow flow pattern, due to the back flow of air in the flow channel, with a resulting partial collapse of the bottle.

Other examples of this approach are found in U.S. Pat. No. 4,664,297 to Giovinazzi, (1987) and U.S. Pat. No. 4,722,463 to Anderson, (1988). These inventions seek to improve the art taught by Daves by adding a venting feature to the valve, whereby there is a separate path for reverse airflow and a vent tube connecting the valve to the ullage space of the bottle during dispensing. Like Daves, both Giovinazzi and Anderson each describe a type of inclined-bottle-holding caddy to use jointly with their respective venting valves. The respective valves, providing, as they do, for the back flow of air to equalize the pressure in the bottle, solve the flow problems associated with Daves' valve. However, the cost of the improved flow is significant increase in the cost and complexity of the respective valves.

None of the cited patents addresses all of the large-bottle problems described above, nor, in any combination, can they fully solve the aggregate problems. In addition to any benefits they offer, they have the following significant limitations and faults:

(a) The art taught by Galbierz addresses only the bundling and carrying problems, and is inadequate when the weight becomes excessive, as it does for multiple two-liter bottles. Also, it requires some effort and knowledge to remove bottles from the carrier, since its intended function is to securely hold bottles by their necks.

(b) The art taught by Daves addresses only the carbonation maintenance and the dispensing problems. It fails to provide good liquid dispensing for thin walled bottles, because negative internal pressure causes partial bottle collapse and noisy, irregular flow.

(c) The bottle caddies taught by Daves, Giovinazzi, and Anderson are not of a type that can be conveniently obtained with the soft drinks at time of purchase, as they cannot be a part of the bottles' package. They are intended to be strong and stylish and to have a long use life. As such, their materials and construction are too expensive to be disposable, and they are too bulky to be convenient when not being used.

(d) The bottle caddies taught by Daves, Giovinazzi, and Anderson are awkward to transport while filling their function of holding bottles. There are no grasping features provided and no convenient handholds shown or described for any of them. It is not practical to carry the caddies with one hand; this reduces their practicality outside of a refrigerator, and is a serious inconvenience if they are used for outings, such as picnics or sporting events, etc.

(e) The added value of the valves taught by Giovinazzi and Anderson over the valve of Daves, is that they provide vented flow. However, they provide venting by means of complicated arrangements of numerous parts and seals; the results are relatively expensive and fragile assemblies, when compared with Daves' valve.

(f) The valves taught by Daves, Giovinazzi, and Anderson all have hidden interior parts and workings. As such they cannot be reliably cleaned after use. The degree of cleanliness cannot be ascertained by visual inspection, and internal passages are not accessible for controlled flushing and rinsing, etc. As a result, sanitation cannot be easily ascertained or ensured.

(g) It is well known that abrupt pressure drops, such as caused by flow through an orifice, can cause out-gassing of carbon dioxide from carbonated beverages. Such out-gassing results in undesirable foaming. The valves taught by Daves, Giovinazzi, and Anderson all exhibit small orifices and flow channels, and the designs are susceptible to undesirable foam production. Excessive foaming results in long dispensing times, and also adversely affects the perceived quality of the dispensed beverage and the quantity of beverage that a cup can hold.

Objects and Advantages

Accordingly, several objects and advantages of the present invention are:

(a) To provide a point-of-sale bottle package that effectively bundles multiple, large beverage bottles in an upright position, whereby two to six bottles, containing one or more kinds of beverage, can be marketed, and carried, as a unit;

(b) To provide a point-of-sale bottle package that permits several heavy beverage bottles to be comfortably and securely carried with only one hand;

(c) To provide a point-of-sale bottle package that provides for quick and easy removal of bottles from the package;

(d) To provide a point-of-sale bottle package with economical materials and construction;

(e) To provide a point-of-sale bottle package with sufficient flat-and-visible surface areas to provide for promotional advertising, through symbols, text, holograms, and pictures;

(f) To provide a point-of-sale bottle package that further serves as a beverage-dispensing caddy, whereby heavy bottles are placed and securely held in an attitude suitable for beverage dispensing with little effort required by the consumer, such that it is suitable for use even by small children or enfeebled adults;

(g) To provide a combination package and beverage-dispensing caddy that is economically suitable for disposal after use;

(h) To provide a bottle caddy that can be easily and securely moved with one hand, while the caddy is supporting bottles;

(i) To provide a valve suitable for beverage dispensing, that can replace the regular bottle cap and can eliminate the potential loss of carbonation due to loose caps;

(j) To provide an economical valve that provides venting during dispensing, and pressure maintenance while not dispensing, such that the vented flow is rapid and aesthetically pleasing;

(k) To provide an economical venting valve whose flow channel is sufficiently large to prevent pressure drop induced foaming;

(l) To provide a venting beverage-dispensing valve with accessible flow paths suitable for inspection and cleaning, thus, enhancing sanitation;

(m) And to provide a bottle package that is suitable for the co-packaging of snack foods and/or complementary articles such as: dispensing valves, disposable plates, cups, and eating utensils, etc., whereby the total packaged value is enhanced and sales appeal increased.

Still further objects and advantages will become apparent from a consideration of the ensuing descriptions and drawings.

DRAWING FIGURES

In the drawings, closely related figures have the same number but different alphabetic suffixes.

Figure 1:
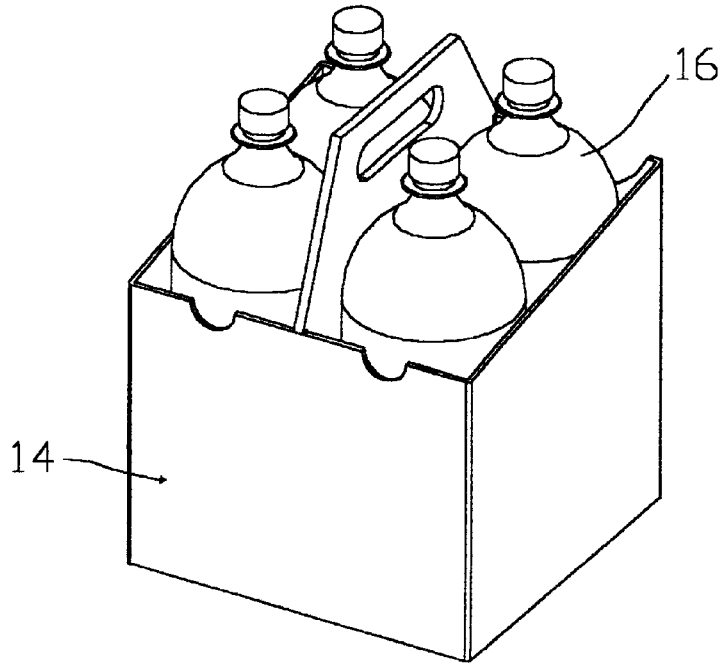
FIG. 1 is an oblique view of a first and preferred embodiment of the combination package and dispensing caddy.

| Reference Numerals In Drawings | |
|---|---|
| 14 caddy | 16 bottle |
| 17 handle | 18 front panel |
| 20 back panel | 22 small notch |
| 24 cavity | 26 side panel |
| 28 central panel | 30 large notch |
| 32 valve | 34 valve cap |
| 36 valve body | 38 pivot axis |
| 40 spring | 42 vent tube |
| 44 flow orifice | 46 vent orifice |
| 48 seal | 50 threads |
| 52 seal | 54 lever |
| 55 channel top | 56 channel sides |
| 58 flow guide | 59 bottle package |
| 60 handle | 62 pivoting hinge |
| 64 bottle holder | 66 central panel |
| 68 end panel | 69 base structure |
| 70 bearing disk | 72 load bearing surface |
| 74 side panel | 76 carton |
| 78 plates package | |

DESCRIPTION—FIGS. 1 THROUGH 5D—PREFERRED EMBODIMENT

In the figures, supporting, strengthening, fastening, and aligning members, such as would be obvious to one skilled in the art, are omitted to enhance clarity. A preferred embodiment of the present invention is illustrated in FIGS. 1 through 5D. This embodiment consists of one or two venting, beverage-dispensing valves and an associated combination package and bottle caddy. Although a novel and surprisingly simple venting, beverage-dispensing valve is disclosed herein, it will be appreciated that the present embodiment is not limited to the use of any specific venting valve design.

In FIG. 1 a caddy 14 contains four large beverage bottles 16, of two-liter capacity, for example.

Figure 2:
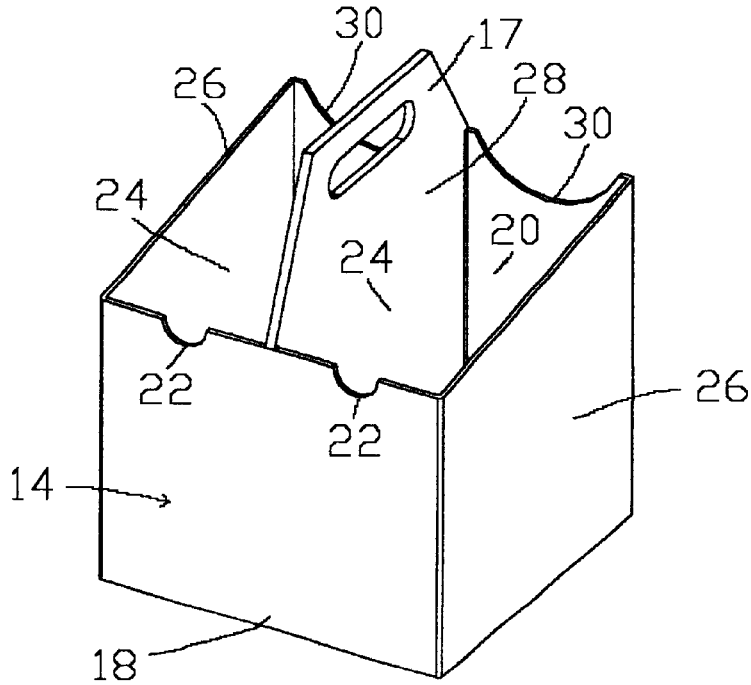
FIG. 2 is identical to FIG. 1 with the bottles removed for clarity.

In FIG. 2 a gripping tab or handle 17 is shown to be centrally located in and integral to a central panel 28. The hole of handle 17 is of such a size and location as to permit comfortable gripping by an adult's hand.

A front panel 18 is shown opposite a back panel 20. Front panel 18 is substantially lower in height than back panel 20, the difference in heights being determined by the desired degree of bottle inclination for beverage dispensing. The difference in height is a subjective choice that is somewhat dependent on aesthetics, bottle size, and dispensing needs, and might be 1½ inches, for example. A side panel 26 joins the front panel 18 and back panel 20 at each end. A cavity 24 exists in each half of caddy 14, that is formed by the bounding panels 18, 20, 26, and 28, and a bottom that is not shown. Each cavity 24 is sized to hold two bottles 16 as shown in FIG. 1.

Figure 3:
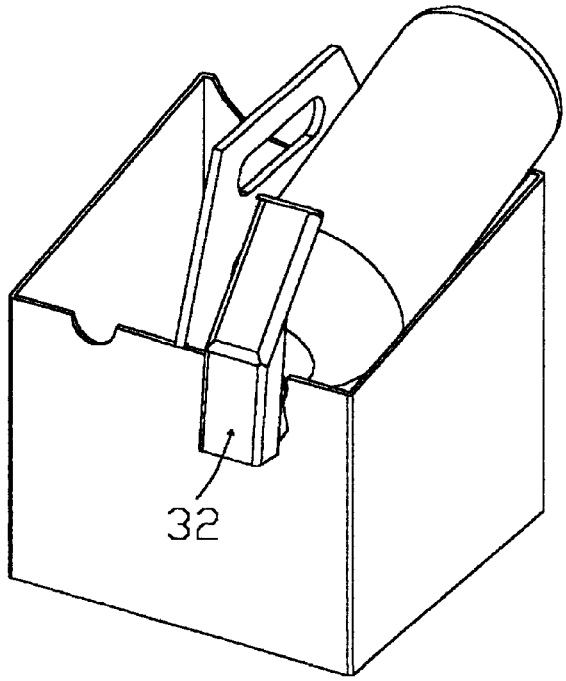
FIG. 3 shows the embodiment of FIG. 1 holding a valve-capped bottle for dispensing.

Two small notches 22 are sized to fit the neck, or top end, of a bottle 16. The top edge of front panel 18 is broken by the notches 22, each of which is centrally located with respect to its respective cavity 24. Notches 22 can be semicircles of 0.6 inch radius, for example. Two large notches 30 are sized to fit the body of the bottle 16. The top edge of back panel 20 is broken by the notches 30, each of which is centrally located with respect to its respective cavity 24. Notches 30 can be circle arcs of 2.2 inches radius, and have a depth of 1¼ inches, for example. Front panel notches 22 and back panel notches 30 are located and sized, to cradle inclined bottles 16, as shown in FIG. 3. The example dimensions given would support a bottle with an approximately 16 degree inclination.

This embodiment, as described, is suitable for holding four bottles 16. It will be obvious that to be suitable for six bottles, each of the cavities 24 would have to be broken up by a notched panel similar to back panel 20, in order to support inclined bottles 16, which would be shorter than the width of side panel 26. Such an added notched panel would obviously have to pass between two bottle positions in each cavity 24.

Figure 4:
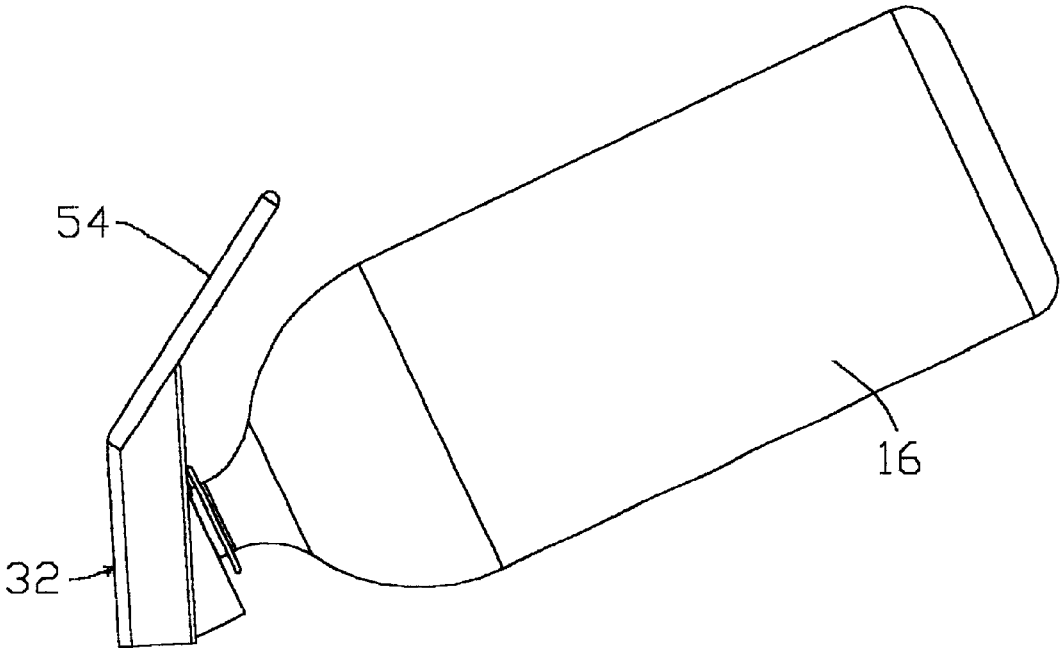
FIG. 4 is an elevation view of a valve-capped bottle in a dispensing orientation.
Figure 5A:
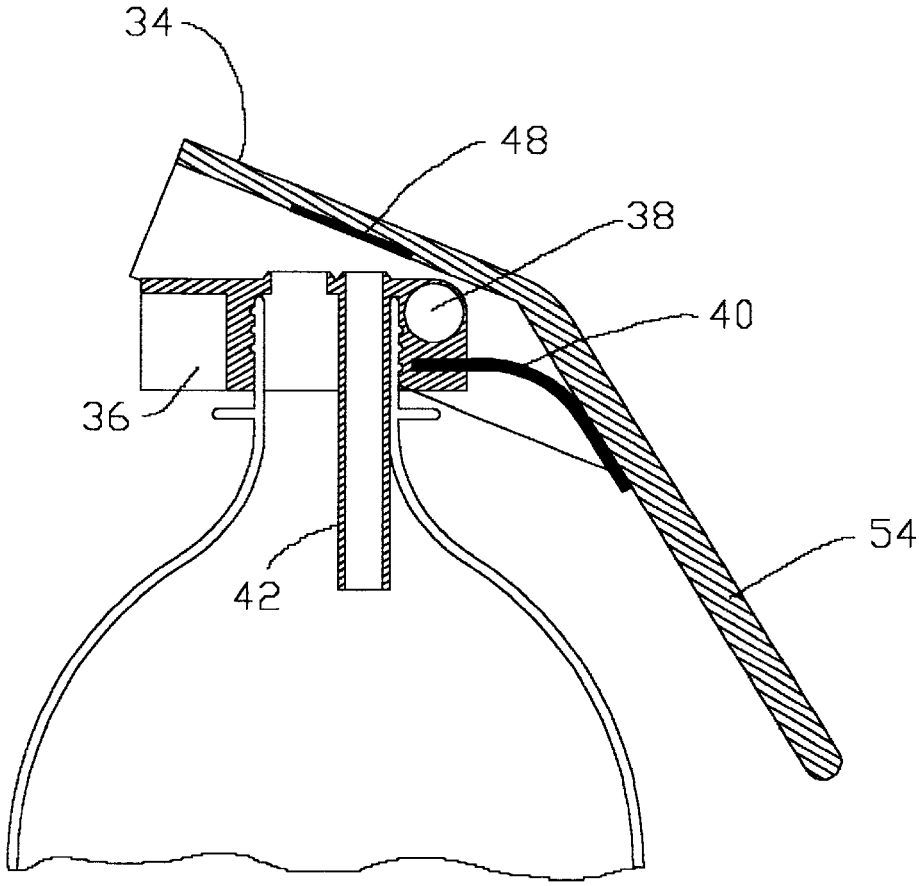
FIG. 5A is a section view of the dispensing valve, shown in the opened, or flow, position.
Figure 5B:
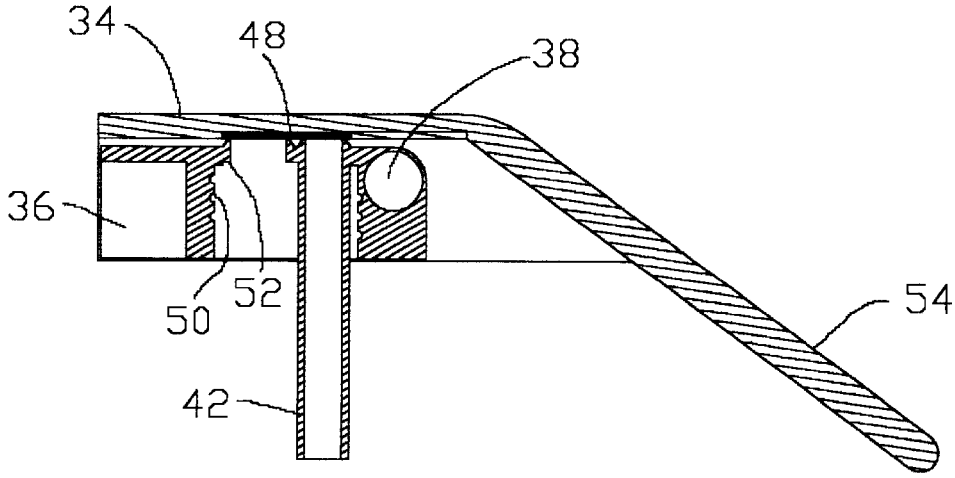
FIG. 5B is a section view of the dispensing valve, shown in the closed, or sealed, position.

FIG. 4 shows a beverage dispensing valve 32 attached to an inclined beverage bottle 16. The details of valve 32 are shown more particularly in FIGS. 5A through 5D. FIG. 5A shows a section view of valve 32, affixed to a bottle. A valve cap 34 is shown in opened, or flow, position in FIG. 5A and in closed, or sealed, position in FIG. 5B. As shown in FIGS. 5A and 5B, valve cap 34 is affixed to a valve body 36 in a manner that permits relative rotation about a pivot axis 38. Pivot axis 38 is shown schematically in the figures. It will be obvious to one skilled in the art that the desired pivoting function can be obtained by a through pin, or equally well by integrally molded pins and sockets in valve cap 34 and valve body 36.

Valve body 36 has internal threads 50, as shown in FIG. 5B, which are functionally identical to bottle-cap threads. A seal 52 is located perpendicular to and at the end of the threaded portion. Seal 52 is sized and located such that it screws down against the topmost surface of a bottle when the valve is screwed on. Surface 52 is functionally equivalent to the inner surface of the top of a normal PET-beverage-bottle cap.

Figure 5C:
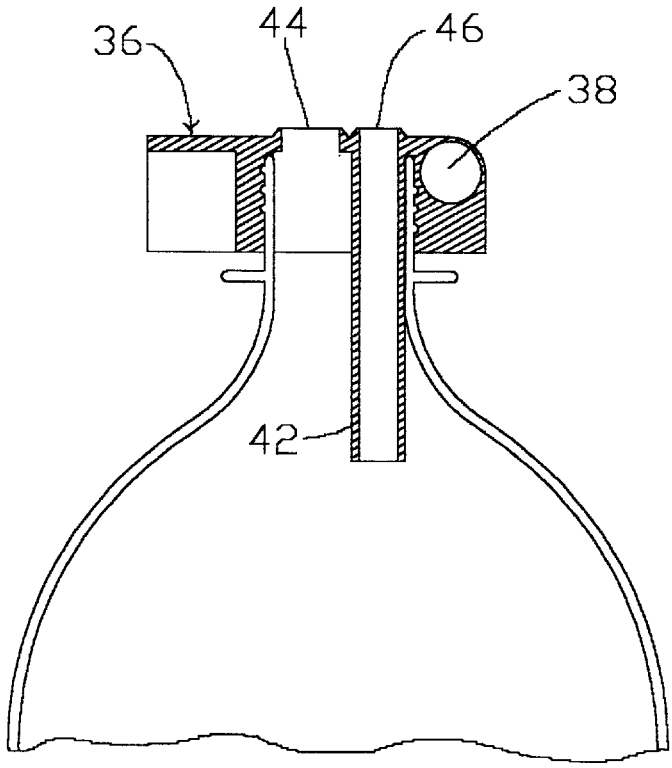
FIG. 5C is a section view of the body portion of the dispensing valve affixed to a bottle.

For clarity, FIG. 5C shows valve body 36 with other valve parts removed. A flow orifice 44 and a vent orifice 46 provide flow paths through valve body 36. Vent orifice 46 is placed in relation to flow orifice 44 in such a manner that it is above the flow orifice, when valve 32 is in a dispensing attitude—as shown by FIG. 4. This is achieved by placing orifices 44 and 46 on a line that is perpendicular to pivot axis 38, and by placing vent orifice 46 closest to the pivot axis. Flow orifice 44 is relatively larger than vent orifice 46. Excellent results can be obtained with a flow orifice diameter of ⅜ inch, and a vent orifice diameter of 3/16 inch, for examples. As shown in FIGS. 5A through 5C, the respective perimeters of flow orifice 44 and vent orifice 46 are raised above the surrounding valve body surface. The increased height can be obtained as an integral molded feature of valve body 36, or as a separately added part for each orifice, such as a compliant o-ring, for example.

The passage defined by vent orifice 46 is extended downwardly into the bottle 16 by a vent tube 42. The interior passage of vent tube 42 is at least of equal diameter to vent orifice 46, and has a length sufficient to reach a region of bottle 16 where the interior diameter of the bottle is significantly increasing. Vent tube 42 may extend the passage, defined by vent orifice 46, by 1½ inches, for example.

A spring 40 is shown in FIG. 5A, that imparts a closing moment to valve cap 34. Spring 40, as depicted, represents a cantilever spring of leaf construction. It will be appreciated that the intended closing moment could be obtained equally well with compression or torsion springs, without loss of generality or functionality. Spring 40 might be sized to impart a closing and sealing moment of 7 inch pounds to valve cap 34, for example.

A compliant seal 48 is shown in FIGS. 5A and 5B. Seal 48 may be used to enhance sealing of orifices 44 and 46, as needed, and may be made of a rubber, for example. Seal 48 may be omitted if compliance is already provided by the material of valve cap 34, the material of valve body 36, or the use of o-rings around orifices 44 and 46, as described above.

Figure 5D:
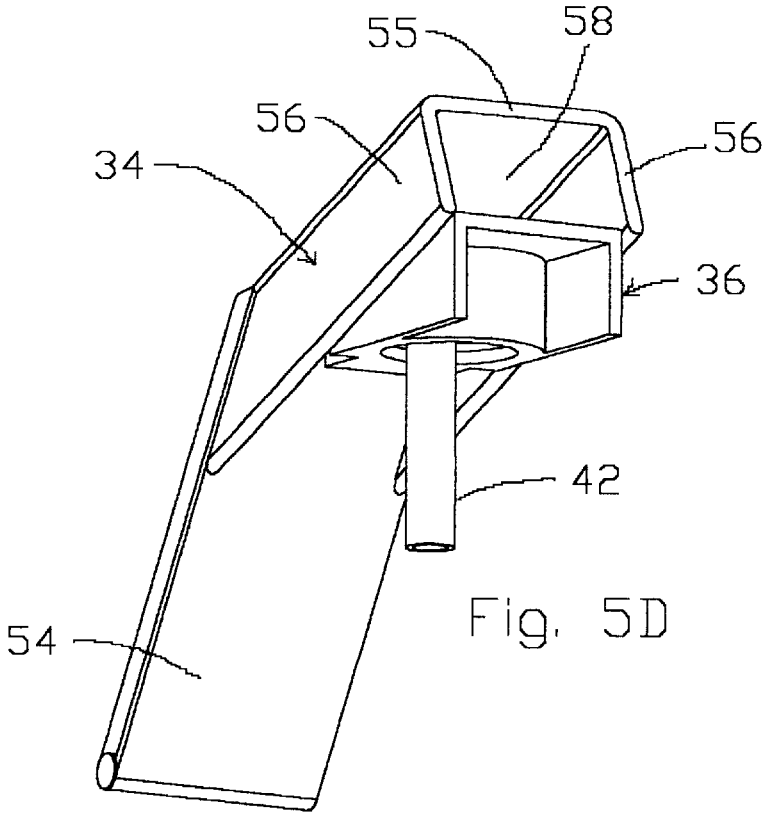
FIG. 5D is an oblique view of the dispensing valve, shown in the flow position.

A lever 54, as shown in FIGS. 5A, 5B, and 5D, is an integral part of valve cap 34. Lever 54 has smooth surfaces and rounded edges and comers for user comfort.

A flow guide 58, as shown in the oblique view of FIG. 5D, is formed when valve cap 34 is pivoted with respect to valve body 36, to the open, or flow position. The upper portion of valve cap 34 is in the shape of a channel that is formed by a channel top 55 and two channel sides 56. The sides 56 loosely fit over valve body 36, in the closed position. As the valve is opened, flow guide 58 is formed by the top of valve body 36 and the channel shape of the upper portion of the valve cap 34.

Operation—FIGS. 1 through 5D—Preferred Embodiment

Though the following description is based upon a four-bottle package, it will be evident that the component parts, and principles described, are just as valid for a six-bottle configuration.

Caddy 14 serves as both a point-of-sale package and a dispensing caddy for large beverage bottles 16. Value is added to the package by using the large, flat, and visible, surfaces that make up the package, for advertisements. By placing symbols, text, pictures, holograms, etc. on the exterior surfaces, caddy 14 becomes a highly visible and repetitive promotional or advertising aid. The large flat surfaces are ideal for printing and silk-screening processes, stick on labels, etc.

Promotional material can be added at the time of manufacture for large production runs, if desirable. If caddy 14 is made from corrugated cardboard, the printing can be done before cutting and folding. However, promotional material can also be added any time after production. Providing "undecorated" caddies permits silk screening, pre-printed labels, or other decorating and printing technologies to be used to add visual material suitable for local promotions. For example, caddies can be locally printed as promotional aids for a local sports team, or school.

The caddys can be offered "empty" in stores, to be filled with beverages of choice by the customer. They can also be offered already loaded with beverage bottles, as would be advantageous if the promotional material is beverage specific. If desirable, a shrink-wrap film can be added to securely hold bottles in the caddies. This feature would be especially advantageous for shipping and storing the packaged units.

Handle 17 makes it easy to carry four full bottles with one hand, and to move the caddy, with one hand, while it is supporting two bottles for dispensing. The handle is above the center of gravity, providing a stable way to move the bottles. The wide hole in the handle permits a comfortable grip, and a way to distribute the load across four fingers. Handle 17 is designed to permit load carrying with the wrist and arm straight and in vertical attitude, thereby maximizing comfort and ergonomic safety.

To use caddy 14 to hold a bottle for dispensing, the bottles must be removed from one or both of cavities 24. The cap is then removed from a bottle, and dispensing valve 32 screwed onto the bottle, by means of threads 50. When the valve is screwed onto the bottle, seal 52 is moved tightly and sealingly against the topmost surface of the bottle, preventing leakage of liquid or gas around threads 50.

The bottle is then placed in caddy 14 in the manner shown in FIG. 3. The caddy holds the bottle in a dispensing attitude, as shown in FIG. 4. Small notch 22 holds the neck of the bottle, at the lower end, and large notch 30 holds the body of the bottle, at the upper end. The bottle, thus positioned, is securely held, and is in an optimum attitude for beverage dispensing.

To dispense beverage, lever 54 of valve 32 is rotated by hand toward the bottle. The caddy provides the necessary resistance to keep the bottle in position and provide stability. As lever 54 is rotated, flow guide 58 forms as the valve opens, and flowing beverage is directed downward for dispensing into any suitable container. As lever 54 is rotated toward the bottle, channel top 55—or seal 48, if present—moves away from flow orifice 44 and vent orifice 46, effectively opening them and permitting liquid flow out of the bottle and air flow into the bottle.

To stop dispensing beverage, hand pressure on lever 54 is removed, permitting spring 40 to rotate valve cap 34 back to the closed position, as shown in FIG. 5B. The channel top 55—or seal 48, if present—is thus sealingly pressed against the tops of flow orifice 44 and vent orifice 46, thereby precluding leakage of liquid or gas. The raised perimeters of orifices 44 and 46, if present, increase the sealing pressure for a given closing force, by reducing the area resisting the closing force.

Valve 32 can be easily cleaned by removing it from the bottle, and cleaning with a normal dishwashing solution. By pivoting valve cap 34 away from valve body 36, all parts, crevices, orifices, and passages can be accessed for inspection and cleaning.

Description—FIGS. 6 through 10—Alternative Embodiment

Figure 6:
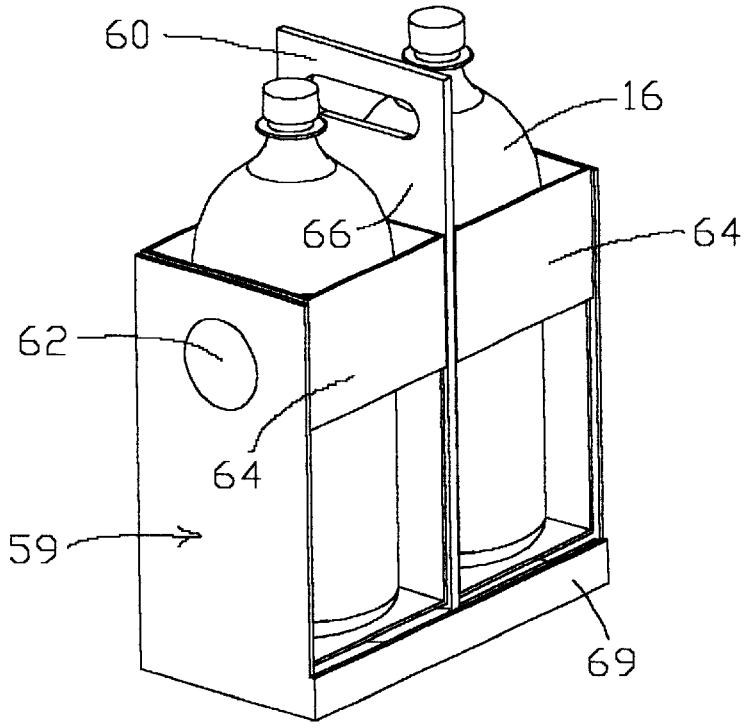
FIG. 6 is an oblique view of a second embodiment of a combination package and dispensing caddy.
Figure 7:
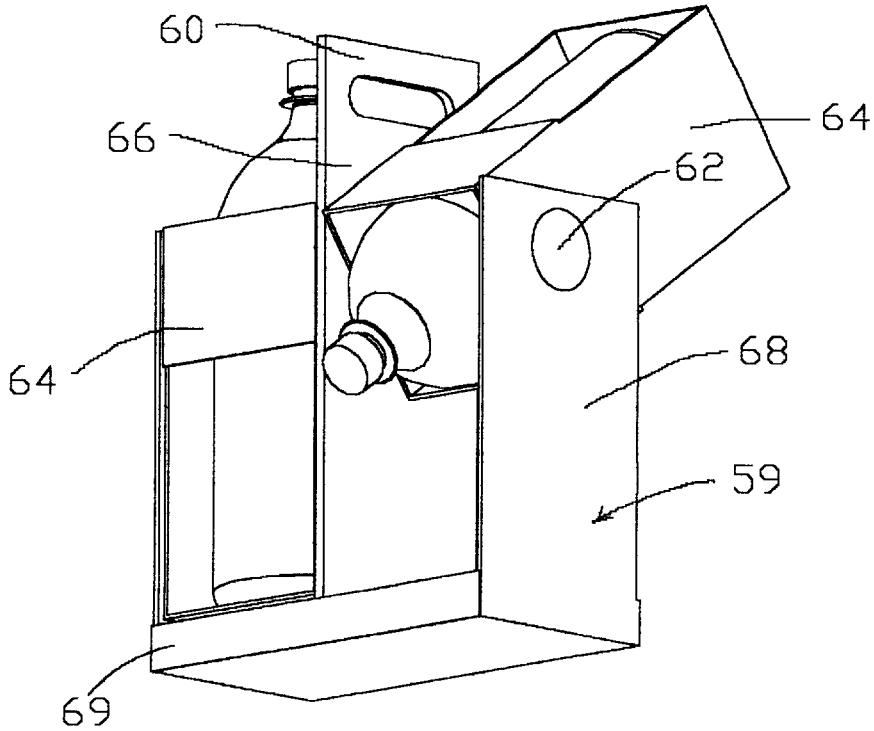
FIG. 7 shows the embodiment of FIG. 6, with a bottle in dispensing orientation.

A second embodiment of a combination bottle package and dispensing caddy is illustrated in FIGS. 6 and 7. FIG. 6 is an oblique view of a bottle package 59 holding two beverage bottles 16, that are of two-liter capacity, for example. A centrally located handle 60 is situated between the tops of the two bottles. Handle 60 is an integral part of a central panel 66, which divides bottle package 59 into two halves. Central panel 66 is rigidly affixed to a base structure 69. Each half of bottle package 59 has a pivoting bottle holder 64, which is sized to snugly hold a bottle of the desired size. For clarity, bottle holder 64 is shown as open on two sides, at the lower end. It will be appreciated that in practice the bottle holder will be so constructed as to securely hold the bottom of bottle 16 as well as the top.

A pivoting hinge 62 is shown schematically. It will be appreciated that the hinge function can be supplied by various means without affecting the generality and functionality of the bottle package. Each bottle holder 64 has two instances of pivoting hinge 62, as is shown in FIGS. 6 through 8D. One hinge fastens the bottle holder to an end panel 68, with pivoting freedom, and the other hinge fastens the bottle holder to central panel 66, with pivoting freedom. There are thus four pivoting hinges 62 in bottle package 59. It will be appreciated that all four hinges share a common axis of rotation, while permitting the two bottle holders 64 to be independently rotated.

It will also be appreciated that the height of the common axis of rotation will affect the stability and ease of rotation of a loaded bottle holder 64. An axis of rotation, that is high above the center of gravity of a full bottle, will cause the bottle to be securely upright while being carried, and while not being manually inclined. On the other hand, an axis of rotation that is only slightly above the center of gravity of a full bottle will permit ease of rotation of a heavy bottle, but will not make a full bottle as stable in the vertical position. In practice, the location of the axis of rotation is subjective, and calls for a compromise of the two approaches.

FIGS. 8A through 8D show oblique section views of bottle package 59 with one of the bottle holders 64 in several progressive stages of rotation. FIG. 7 is an oblique view of a loaded bottle package 59, with a bottle rotated to a dispensing attitude.

Figure 9A:
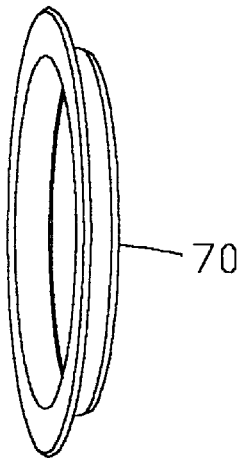
FIGS. 9A and 9B are oblique views of a bearing disk.
Figure 9B:
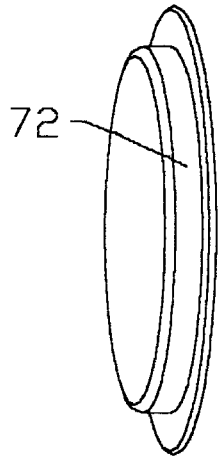
Figure 10:
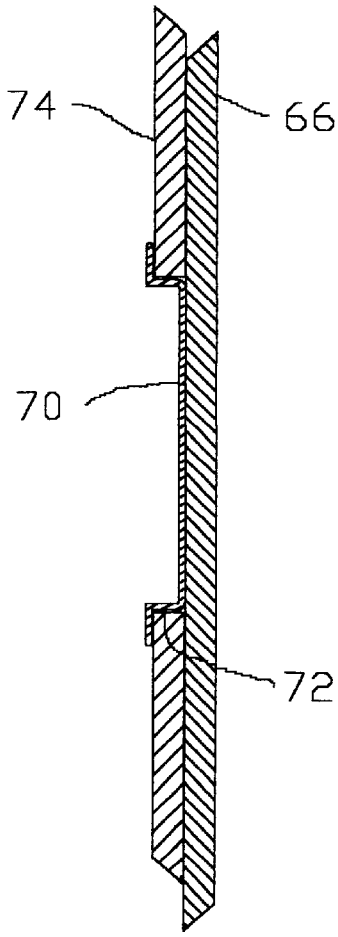
FIG. 10 is a section view of a pivot bearing assembly.

FIGS. 9A and 9B show oblique views of a bearing disk 70 that is suitable for making pivoting hinge 62. A load bearing surface 72 is shown in FIGS. 9B and 10. Bearing disk 70 can be inexpensively made of plastic, for example. The size of bearing disk 70 is not critical; the diameter of load bearing surface 72 might be 1¾ inches, for example. It will be appreciated that the diameter of the load bearing surface 72 needs to be large enough to make the bearing pressure exerted on the material of a side panel 74 acceptably low. Obviously, a side panel made of corrugated cardboard will require a larger bearing disk 70, than will a side panel made of a stronger plastic.

Figure 8A:
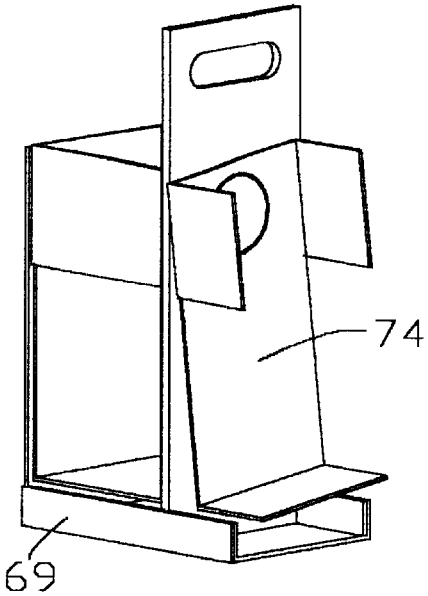
FIGS. 8A through 8D are oblique section views, of the embodiment of FIG. 6, showing progressive rotation of one of the bottle holders.
Figure 8B:
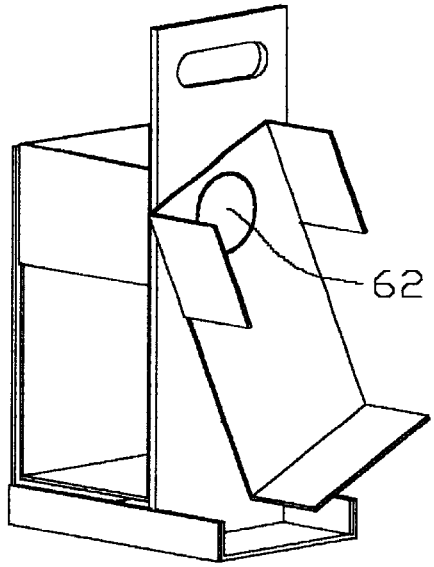
Figure 8C:
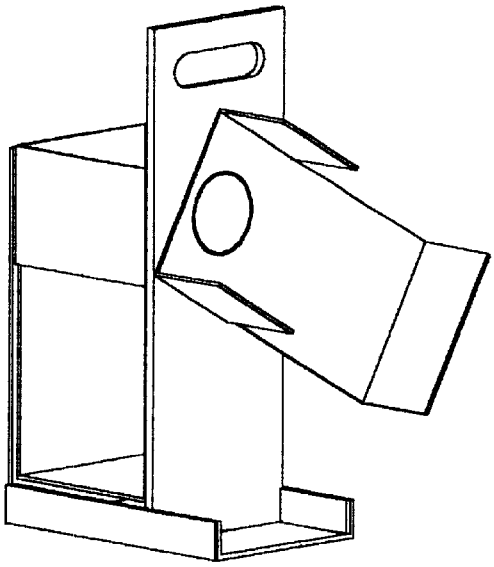
Figure 8D:
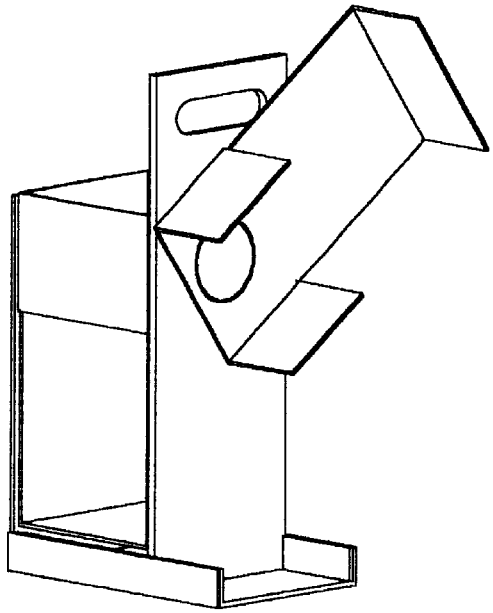

A side panel 74 of bottle holder 64 is shown adjacent to central panel 66 in FIG. 8A. FIG. 10 shows a section view of an embodiment of pivoting hinge 62, made with bearing disk 70. As shown in FIG. 10, a portion of side panel 74 and a portion of central panel 66 are shown as joined in hinging manner by bearing disk 70. As depicted, bearing disk 70 is loosely fitted in a hole in side panel 74, such that the inner edge of the hole is concentric with bearing surface 72. Because it is a loose fit, side panel 74 can rotate about bearing disk 70, but is laterally constrained by the flange of bearing disk 70, on the left side, and central panel 66, on the right side. The abutting surfaces of bearing disk 70 and central panel 66 are joined in fixed relationship to form a fastening and hinging relationship between central panel 66, bearing disk 70, and side panel 74. The means of fastening bearing disk 70 to central panel 66 is not critical, and may be accomplished by staples or hot melt glue, for example.

Operation—FIGS. 6 through 10—Alternative Embodiment

Bottle package 59 serves as both a point-of-sale package and a dispensing caddy for two large beverage bottles 16. Value is added to the package by using the large, flat, and visible, exterior surfaces that make up the package, for advertisements. By placing symbols, text, and pictures on the exterior surfaces, bottle package 59 becomes a highly visible and repetitive promotional or advertising aid. The large flat surfaces are ideal for printing and silk-screening processes, etc.

Promotional material can be added at the time of manufacture for large production runs, if desirable. If bottle package 59 is made from corrugated cardboard, the printing can be done before cutting and folding. However, promotional material can also be added any time after production. Providing "undecorated" bottle packages permits silk screening, pre-printed labels, or other decorating and printing technologies to be used to add visual material suitable for local promotions. For example, bottle packages can be locally printed as promotional aids for a local sports team, or school.

The bottle packages 59 can be offered "empty" in stores, to be filled with beverages of choice by the customer. They can also be offered already loaded with beverage bottles, as would be advantageous if the promotional material is beverage specific. If desirable, a shrink-wrap film can be added to securely hold bottles in the caddies. This feature would be especially advantageous for shipping and storing the packaged units.

Handle 60 makes it easy to carry two full bottles with one hand. The handle is above the center of gravity, providing a stable way to move the bottles. The wide hole in the handle permits a comfortable grip, and a way to distribute the load across four fingers. Handle 60 is designed to permit load carrying with the wrist and arm straight and in vertical attitude, thereby maximizing comfort and ergonomic safety.

This embodiment can profitably be used with the dispensing valve 32, of the previous embodiment, thus obtaining the dispensing and sealing advantages of the valve. However, unlike the first embodiment, this embodiment can also be used without a dispensing valve, and will be so described here. The advantage is an obviously lower cost, since the cost of the valve, or valves, is eliminated. The obvious disadvantage is the loss of secure sealing between dispensings, with the potential for loss of carbonation. However, this disadvantage is insignificant, if the beverage is intended for same day consumption. This is usually the case for outings, such as picnics, camping trips, and sporting events.

To dispense beverage, the cap is removed from the bottle 16, which is securely held by bottle holder 64. The bottle 16 and bottle holder 64 are then rotated, by hand, about the pivot axis defined by the pivoting hinges 62, permitting the bottled beverage to pour out into a waiting container. Because the bottle weight is supported by the pivoting hinges 62, and because the pivoting axis is judiciously chosen to reduce the force needed to rotate the bottle, the act of dispensing requires little force or strength. The bottle cannot be dropped; if the hand is removed, the bottle will swing upright to a stable, non-spilling, position. The bottle, or bottles, in package 59 are much more stable than a bottle standing alone on a flat surface.

To cease dispensing, the bottle 16 and bottle holder 64 are permitted to return to the stable vertical position, and the cap is replaced.

It will be apparent that bottle holders 64 can be rotated in either direction with equal ease. Because of this bidirectional access, the stability of the stationary package, the ease of passing the package from one person to another, and the potential for offering two beverages, this embodiment is practical and valuable for placing on a table at meal time. The ease of dispensing makes this embodiment easily used by children and enfeebled adults, alike.

Figure 11:
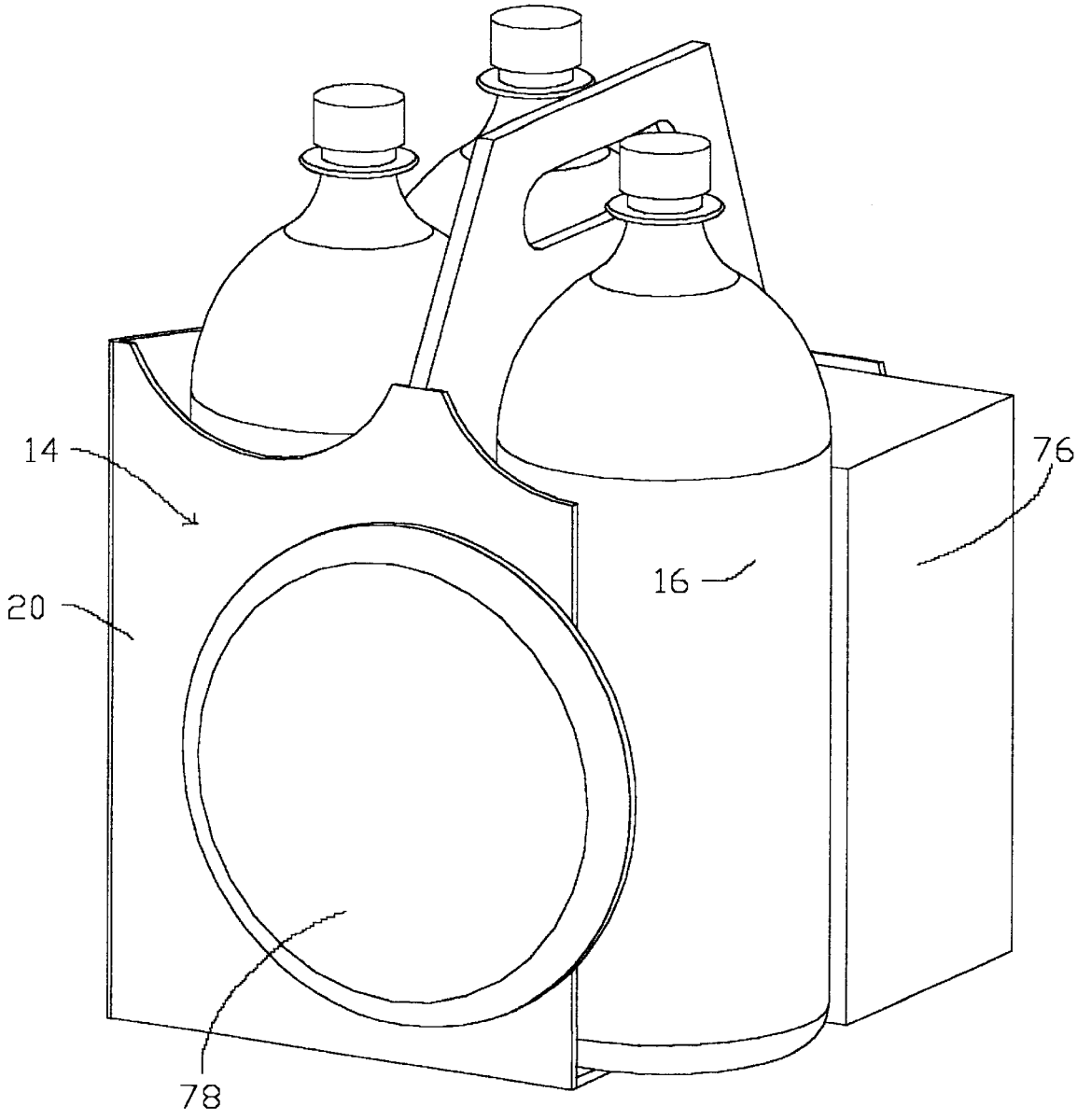
FIG. 11 is an oblique view of a third embodiment of a combination package and dispensing caddy, showing co-packaging of complementary articles.

Description—FIG. 11—Additional Embodiment

A third embodiment of the present invention is illustrated in oblique section view in FIG. 11. This embodiment is identical to the first embodiment in most particulars. The same caddy 14 and the same dispensing valve 32, are part of this embodiment. A carton 76 has a height, width, and depth, which permit it to replace a bottle 16 in cavity 24 of caddy 14, as shown in FIG. 11. The width and depth will be limited by the diameter of bottle 16; the height will be limited by potential interference with usage of handle 17. It will be appreciated that carton 76 may be a separate item, that may be placed in cavity 24, or may be an integral part of caddy 14. Carton 76 may be enclosed and even sealed at its top, or may be left open if usage suggests.

Carton 76 is not restricted to box shape. When the carton is not an integral part of the caddy, a cylindrical shape and construction, such as is commonly used for nut packages, will serve very well for many applications.

A disposable plate package 78 is shown at one end of caddy 14, in FIG. 11. The disposable plate package, as shown, is affixed to the exterior of back panel 20. The disposable plates are packaged in a plastic overwrap—not shown—which is attached to back panel 20, by staples or adhesive, for example. Disposable plate package 78 may also profitably contain a disposable tablecloth and disposable napkins, etc.

Operation—FIG. 11—Additional Embodiment

The operation of this embodiment is the same as for the first embodiment. Bottle packaging, drink dispensing, and valve operation, are as previously described. The potential and usage of promotional advertising are as before described. However, there are additional benefits due to the addition of one or more cartons 76 and/or disposable plate package 78 to the first embodiment.

Carton 76 is used to co-package associated items with bottled beverages. It may, for example, be used to package such items as: one or two dispensing valves 32, nested drinking cups, disposable eating utensils, condiments, paper napkins, disposable table cloth, waterproof ground cloth, etc. Carton 76 may also be used to package snack foods that are compatible with bottled soft drinks, for examples, mixed nuts and pretzels. Carton 76 may also be used to package VCR cassettes to promote a specific movie or movies, and a specific soft drink. It is obvious that multiple cartons 76 may be associated with one caddy 14.

For example, a caddy 14 that is sized and configured to hold six bottles 16, can hold four beverage bottles, two cartons 76, and attached disposable plate package 78. Four two-liter bottles of beverage, disposable plates, a carton 76 containing snack foods, and a carton 76 containing items such as those listed above, would serve well as a party package or a picnic package. A caddy packaging beverages, snack foods, and movie cassettes would serve well as an entertainment package. Convenience and economy is provided by co-packaging associated items in balanced single-occasion amounts.

In keeping with the previous description of value adding promotional material, for the first embodiment, it is obvious that the cartons 76, and the disposable cups, plates, napkins and table cloth, etc., provide suitable visible, and printable, surfaces for displaying promotional symbols, text, and pictures.

Conclusion, Ramifications, and Scope

Accordingly, the reader will see that the present invention, as defined by the embodiments described, herein, can be used to package, carry, and dispense bottled beverage, with an economy, ease and convenience not obtainable with prior art. Specifically:

- it provides a point-of-sale multiple-large-bottle package for two to six beverage bottles.
- it provides a package that permits several heavy, beverage bottles to be safely, comfortably and securely carried with only one hand.
- it provides a bottle package whereby bottles can be quickly and easily removed for use.
- it provides a disposable combination bottle package and dispensing caddy.
- it provides a point-of-sale bottle package with flat-and-visible surface areas, suitable for displaying promotional advertising.
- it provides a point-of-sale bottle package that serves as a beverage-dispensing caddy, whereby heavy bottles are securely and easily placed and held for beverage dispensing.
- it provides a bottle-dispensing caddy that can be easily and securely moved with one hand.
- it provides an economical venting, beverage-dispensing valve that eliminates the potential loss of carbonation due to loose caps, and is suited for thin walled PET bottles.
- it provides a venting valve, that is substantially free of orifice pressure drop induced foaming.
- it provides a venting, beverage-dispensing valve, that is easily cleaned and inspected, thereby promoting sanitation.
- it provides a bottle package that is suitable for co-packaging beverages with snack foods and/or complementary articles, for enhancing the total packaged value and sales appeal.

Although the above descriptions contain many specificities, these should not be construed as limiting the scope of the invention but as merely providing illustration of some of the presently preferred embodiments of this invention. Many other variations are possible. For examples:

(1) the spring, in the valve described in the preferred embodiment can be a leaf spring, a torsion spring, a compression coil spring, an elastic band, or an elastomeric compression spring; it will be obvious to one skilled in the art how to implement any of these ramifications.

(2) the pivoting hinge described in the second embodiment can be formed by plastic or metal rivets and washers, or by integrally molded bearing surfaces and mating recesses that snap together.

(3) the caddy or package of each described embodiment can be made of cardboard, of extruded, cast, molded, or formed plastic, or of rigid foamed materials.

The scope of usage extends beyond beverages, and includes, but is not limited to:

- the described venting valve being used in conjunction with large containers of fabric bleach or concentrated household, or industrial, cleaners, etc.
- the bottle tilting package of the second embodiment being used to provide stability and ease of pouring for large bottles of almost any kind of liquid, including industrial and laboratory chemicals.
- the third embodiment being used to co-package bottled, pre-mixed, cleaning or sterilizing solutions, and associated cleaning items, such as protective gloves, sponges and brushes, for industrial and medical cleaning applications.

Accordingly, the scope of the invention should be determined not by the embodiments illustrated, but by the appended claims and their legal equivalents.

We claim:

1. A combination dispensing caddy and package for a plurality of large bottles comprising:

a. a central panel with an incorporated handle near its top, and b. a first notched exterior panel, with two notches in its top edge, and oriented perpendicular to said central panel, and c. a second notched panel, of greater height than, and parallel to, said first notched exterior panel, with two larger notches in its top edge, said second notched panel potentially either an exterior or an interior panel of said package, wherein said notches and said larger notches are in the form of cradling surfaces for inclined bottles, and d. a second exterior panel, oriented parallel to said first notched panel, said second exterior panel may, or may not, be said second notched panel, as the bottle capacity of said package dictates, and e. two exterior side panels, each joined to an end of each of said notched panels and said second exterior panel, and f. a bottom that is perpendicular to, and affixed to, all said panels, wherein each of said notched panels and said second exterior panel is vertically intersected, near its centerline, by said central panel, and wherein said bottom and said panels define cavities, suited for holding bottles, and interior and exterior surfaces of said package, and whereby said package uniquely serves both as a sales package and a dispensing caddy for large bottles.

2. The combination dispensing caddy and package of claim 1, further including an air-venting liquid-flow valve sealingly affixed to a liquid containing bottle, said bottle being supported and held in a dispensing attitude by said caddy, whereby liquid is readily dispensed, and said bottle is otherwise tightly sealed.

3. The combination dispensing caddy and package of claim 1, further comprising an ancillary package that is affixed to one of said exterior surfaces of said caddy, whereby associated items, such as disposable plates, for example, can be co-packaged with bottled beverages.

4. The combination dispensing caddy and package of claim 1, further comprising one or more ancillary packages that are sized and constructed to nestingly fit within said cavities, whereby associated items, such as snack foods, for example, can be co-packaged with bottled beverages.

5. The combination dispensing caddy and package of claim 1, further further including surfaces of said panels in combination with means for displaying promotional and advertising materials.

6. A flow valve for bottled liquid comprising:

a. a valve body in combination with means for simultaneously dispensing said bottled liquid and replacing said liquid with venting air, said valve body sealingly affixed to a bottle, and b. a valve cap in combination with means for joining said valve body and said valve cap and for forming an axis of relative pivoting, and c. one or more springs providing a closing moment of said valve cap about said axis, and d. said springs in combination with means for pressing said valve cap to said valve body in a sealing manner, and d. a lever for manual actuation of said flow valve, said lever an integral feature of said valve cap, whereby said valve provides for ease of vented dispensing of said liquid, and further provides for gas and liquid tight sealing of said bottle.

7. The flow valve of claim 6 wherein said valve body further includes internal threads and an inner seal, whereby said valve can replace a normal bottle cap by screwing onto the neck of said bottle.

8. The flow valve of claim 6 wherein a liquid stream flow guide is formed by a channel of said valve cap and an upper surface of said valve body, whereby the dispensed liquid is directed downward into a receiving vessel.

9. A combination dispensing caddy and package for two large bottles comprising:

a. a central panel with an incorporated handle near its top, and b. two exterior end panels, and c. a base structure affixed in a supporting manner to said exterior end panels and said central panel, and d. two bottle holders in combination with means for fastening each of said bottle holders in pivoting manner to said central panel and to one of said end panels, wherein said bottle holders are independently pivotable about an axis located above the center of gravity of said bottles, and whereby said bottles are supported in said bottleholders, and whereby said said bottles may be uncapped and said bottles and said bottleholders may be pivoted to dispense liquid in a stable and easy manner.

10. The combination dispensing caddy and package of claim 9, further including an air-venting liquid-flow valve sealingly affixed to one of said bottles, whereby liquid can be readily dispensed, and said bottle is otherwise tightly sealed.

11. The combination dispensing caddy and package of claim 9, further further including surfaces of said panels, and of said bottle holders, in combination with means for displaying promotional and advertising materials.

* * * * *